US005286929A

United States Patent [19]

Kazama et al.

[11] Patent Number: 5,286,929

[45] Date of Patent: Feb. 15, 1994

[54] NOVEL SOUND ABSORBING MATERIALS

[75] Inventors: Shigenori Kazama, Yokohama; Hiroshi Sugawara, Zushi; Yugoro Masuda, Takatsuki; Akira Dono, Osaka, all of Japan

[73] Assignees: Nissan Motor Co., Ltd., Yokohama; Kanebo Ltd., Tokyo, both of Japan

[21] Appl. No.: 995,739

[22] Filed: Dec. 22, 1992

[30] Foreign Application Priority Data

Dec. 27, 1991 [JP] Japan ..... 3-346192

[51] Int. Cl.[5] ..... E04B 1/82

[52] U.S. Cl. ..... 181/286; 428/224; 428/284; 428/288; 428/296; 428/397

[58] Field of Search ..... 181/286, 294, 208; 428/224, 284, 288, 296, 397

[56] References Cited

U.S. PATENT DOCUMENTS

| | | | |
|---|---|---|---|
| 4,639,397 | 1/1987 | Sato et al. | 428/224 |
| 4,898,783 | 2/1990 | McCullough et al. | 428/408 |

FOREIGN PATENT DOCUMENTS

| | | |
|---|---|---|
| 0198401A1 | 10/1986 | European Pat. Off. . |
| 0365979A2 | 4/1990 | European Pat. Off. . |
| 0493728A1 | 7/1992 | European Pat. Off. . |
| 63-181760 | 7/1988 | Japan . |
| 1-148860 | 6/1989 | Japan . |
| 1514530 | 6/1978 | United Kingdom . |

*Primary Examiner*—Michael L. Gellner
*Assistant Examiner*—Khanh Dang
*Attorney, Agent, or Firm*—Foley & Lardner

[57] ABSTRACT

A sound absorbing material comprises a fiber gathered body containing at least 50% by weight of synthetic fiber staples and having a mean density of 0.02–0.2 g/cm$^3$, in which at least 30% by weight of irregular-shaped fibers having a particular sectional shape are contained in the fiber gathered body.

3 Claims, No Drawings

NOVEL SOUND ABSORBING MATERIALS

BACKGROUND OF THE INVENTION

1. Field of the Invention

This invention relates to a novel sound absorbing material used in an automobile compartment and an engine room, and more particularly to an interior material for automobile requiring sound absorption, sound insulation, sound proof and the like such as ceiling material, door trim, pillar trim, instrument panel, and so on.

2. Description of the Related Art

A sound insulation structural body for an automobile is constructed so as to shut out engine sound as a noise source of a vehicle body, or road noise generated from a tire in order to hold a comfortable environment for the crew. Such a structural body is mainly arranged on a vehicle body being a vibration body at a side of the compartment. In this case, however, the sound insulation is substantially born by a surface cover arranged apart from the panel, but sufficient sound insulating performance is not developed only by the hollow double wall structure consisting of the panel and the surface cover. Therefore, a so-called felt formed by strengthening regenerated short fibers wit phenolic resin or the like is inserted into a hollow portion for supporting the surface cover from the panel, whereby the sound insulating performance is developed as a sandwich structure essentially consisting of the panel, the felt and the surface cover.

In the conventional sound insulation structural body, however, if it is intended to improve the sound insulating performance, it is attempted only to increase the weights of panel and surface cover, or to increase the thickness of the felt. The former case tends to increase the vehicle weight, which is out of a trend of reducing the weight for the improvement of fuel consumption and motive power recently required in the automobile. The latter case tends to reduce the volume of the compartment, which is out of a trend of requiring the comfortable environment.

SUMMARY OF THE INVENTION

It is, therefore, an object of the invention to solve the aforementioned problems of the conventional technique and to provide a novel sound absorbing material having an improved sound insulating performance by using a fiber gathered body having an excellent sound absorbing property as an instrument panel or floor insulator developing a higher sound insulating performance for realizing a silent interior space.

The inventors have analyzed the function of the fiber gathered body in order to attain the above object, and found that the sound insulating performance can be enhanced by giving sound absorbing property to the fiber gathered body, and as a result the invention has been accomplished. That is, energy transmitted from a sound source such as engine, tire or the like to the panel as sound or vibration is emitted as a sound to the fiber side and multi-reflected between the fibers and the surface cover. In fact, sound emitted from the surface cover to the inside of the compartment is a sound energy stored by such a multi-reflection. Therefore, if vibration energy of air is absorbed by any means during the multi-reflection, the sound insulating performance is improved as a whole. The conventionally used felt is generally a porous body of fibers, which has a sound absorbing property as well-known from Japanese Patent laid open No. 63-181760 and No. 1-148860. However, the fibers constituting the felt are almost circle in the section, so that the great effect of improving the sound absorbing property can not be expected.

On the contrary, the essential point of the invention lies in that sound energy is positively absorbed by rendering the section of the fiber into an irregular section other than the circle. The term "irregular section" used herein means a sectional shape of the fiber that an outer peripheral length of the irregular shaped fiber is longer than an outer periphery of circular fiber when the sectional area of the fiber is the same, and includes convex polygons such as triangle, rectangle and the like; concave polygons such as Y-shape, cross shape, star shape and the like; and a finely divided fiber apparently showing a bundle of superfine fibers. However, in case of the hollow fiber, the inner surface is not included in the irregular section.

When the sectional area of the fiber is S, a circle equivalent radius r is represented by the following equation:

$$r = \sqrt{(S/\pi)}$$

According to the invention, the irregular-shaped fiber has a sectional shape that an outer peripheral length L is larger by at least 20% than $2\pi r$ or satisfies the following equation (I):

$$L \geqq 1.2 \times (2\pi r) \quad \text{(I)}$$

For example, the outer peripheral length of the regular triangle is larger by 28% than that of the circle when the sectional area is the same.

The longer the outer peripheral length, the larger the surface area of the fiber, and hence the multi-reflection of sound becomes easier and also the contact area between the fibers becomes wider to more generate friction between the fibers. As a result, the direction of force at each microarea of the fiber gathered body becomes ununiform and hence the bending force, tension and the like are applied to the fibers. This means that the vibration energy of air can efficiently be converted into the motion of fibers, which results in the effective sound absorption by the sectional shape of the fiber defined in the invention.

DESCRIPTION OF THE PREFERRED EMBODIMENTS

The sound adsorbing material according to the invention is a fiber gathered body shaped from at least 50% by weight of synthetic fiber staples having a yarn fineness of not more than 5 denier, preferably synthetic fiber staples formed by using a resin having a specific gravity of not more than 1.8, and having a mean density of 0.02–0.2 g/cm$^3$, in which at least 30% by weight, preferably 30–95% by weight of fibers having a sectional shape defined by the above formula (I) are included in the fiber gathered body.

In a preferred embodiment of the invention, heat-fusible fibers or heat-fusible composite short fibers having a melting point lower by at least 30° C. than that of the synthetic fiber staple are used as a binder for fixing the shape of the fiber gathered body. Further, the fiber gathered body is shaped by uniformly piling the fiber gathered bodies one upon the other and filling them in a mold, and then drying or heating the piled bodies with steam.

When the amount of the irregular section fibers is less than 30% by weight, the sound absorbing efficiency of the fiber gathered body lowers and the effect of using the irregular section fiber becomes less. Moreover, if the amount is more than 95% by weight, the amount of the binder used becomes less and the fiber gathered body can not be formed. Therefore, the amount of the irregular section fibers used is preferably within a range of 30% to 95% by weight.

When the yarn fineness of the synthetic fiber staple is more than 5 denier, a ratio of surface area to sectional area in the fiber becomes large and hence the sound energy can not efficiently be absorbed. However, about 5–20% by weight of fibers having a fineness of about 10–20 denier may effectively be used together with the synthetic fiber staples in view of the enhancement of rigidity.

When the mean density is less than 0.02 g/cm$^3$, the ratio of the irregular section fibers occupied in the fiber gathered body per unit volume becomes less and hence the sufficient permeation resistance is not obtained and finally the sound absorbing property is insufficient. While, when it is more than 0.2 g/cm$^3$, the motion of the fibers themselves is restricted and the sufficient sound absorption can not be expected, and also the fiber gathered body becomes too rigid and vibrations from the panel is directly transmitted to the surface cover. Moreover, the unnecessary increase of the density in the fiber brings about the increase of the weight, which is out of the trend of reducing the weight.

As the synthetic fiber staple made from a resin having a specific gravity of not more than 1.8, there are preferably used thermoplastic fibers such as polyester fiber, polyamide fiber, polypropylene fiber, polyethylene fiber and the like. In case of inorganic fibers such as glass fiber, mineral fiber or the like and metal fibers such as steel wool or the like, the rigidity of the fiber is too large and the sufficient friction can not be obtained between the fibers, and also the vibration damping performance of the fiber itself is too small and vibrations are directly transmitted to the surface cover. Furthermore, the latter fibers are lacking in the workability during the heat shaping.

The reason why the heat fusible fiber or the heat fusible composite short fiber is used as a binder is due to the fact that the mixing of the binder and other fibers are uniformly conducted and the shape of the fiber gathered body is strongly held. If a powdery resin is used as a binder, there is a fear of locally solidifying the binder or damaging the shape of irregular section by uniformly adhering solvent-type resin to the surface of the irregular section fiber.

The heat fusible fiber or heat fusible composite short fiber is made from at least one thermoplastic polymer selected from polyamide, copolyamide, polyester, copolyester, polyacrylonitrile, copolyacrylonitrile, polyolefin, polyvinyl chloride, polyvinylidene chloride and so on in the usual manner. Among these polymers, polyester is preferable in view of high Tm and relatively cheap cost. If the heat fusible fiber or the heat fusible composite short fiber as a binder is made from two or more polymers, it is required that the mixture of the polymers contains not less than 50% by weight of a polymer constituting a major part of the fiber. Moreover, the fineness of the heat fusible fiber or the heat fusible composite short fiber is preferable to be not more than 5 deniers.

The fiber gathered body according to the invention is rendered into a desired shape by a well-known method, which can be used as a sound absorbing material for engine room and automobile compartment such as roof, sheet, trim or the like.

The following examples are given in illustration of the invention and are not intended as limitations thereof.

EXAMPLE 1

Into a mold are charged 80% by weight of short fibers obtained by cutting rectangular section polyester fibers of 2 denier into a length of 50 mm and 20% by weight of sheath-core type low melting polyester fibers having the same cut length as a binder, in which a melting point of the sheath portion of 3 denier is 110° C., so as to have a density of 0.04 g/cm$^3$, to which is blown hot air at a shaping temperature of 150° C. to obtain a fiber gathered body having a thickness of 30 mm.

EXAMPLE 2

Into a mold are charged 80% by weight of short fibers obtained by cutting triangular section polyester fibers of 2 denier into a length of 50 mm and 20% by weight of sheath-core type low melting polyester fibers having the same cut length as a binder, in which a melting point of the sheath portion is 110° C., so as to have a apparent density of 0.04 g/cm$^3$, to which is blown steam at a shaping temperature of 135° C. to obtain a fiber gathered body having a thickness of 30 mm.

EXAMPLE 3

Into a mold are charged 80% by weight of short fibers obtained by cutting rectangular section polyester fibers of 2 denier into a length of 50 mm and 20% by weight of sheath-core type polyester fibers having the same cut length as a binder, in which a melting point of the core portion is 256° C. and a melting point of the sheath portion is 130° C., so as to have a density of 0.04 g/cm$^3$, to which is blown hot air at a shaping temperature of 170° C. to obtain a fiber gathered body having a thickness of 30 mm.

EXAMPLE 4

Two fiber gathered bodies obtained in Example 1 are piled one upon the other and hot pressed at 150° C. to obtain a fiber gathered body having a density of 0.08 g/cm$^3$ and a thickness of 30 mm.

EXAMPLE 5

Into a mold are charged 50% by weight of rectangular section polyester fiber of 2 denier, 20% by weight of heat fusible polyester fiber of 3 denier and 30% by weight of circular section polyester fiber of 2 denier so as to have a density of 0.04 g/cm$^3$, to which is blown hot air at a shaping temperature of 150° C. to obtain a fiber gathered body having a thickness of 30 mm.

COMPARATIVE EXAMPLE 1

Into a mold are charged 80% by weight of short fibers obtained by cutting circular section polyester fibers of 2 denier into a length of 50 mm and 20% by weight of low melting polyester fibers of 3 denier having the same cut length as a binder so as to have a density of 0.04 g/cm$^3$, to which is blown hot air at a shaping temperature of 150° C. to obtain a fiber gathered body having a thickness of 30 mm.

COMPARATIVE EXAMPLE 2

Into a mold are charged 80% by weight of short fibers obtained by cutting hollow section polyester fibers of 2 denier into a length of 50 mm and 20% by weight of low melting polyester fibers of 3 denier having the same cut length as a binder so as to have a density of 0.04 g/cm$^3$, to which is blown hot air at a shaping temperature of 150° C. to obtain a fiber gathered body having a thickness of 30 mm.

TEST EXAMPLE

Each of the fiber gathered bodies obtained in Examples 1–5 and Comparative Examples 1–2 is placed on a dash board and a floor panel of an automobile and then covered with a polyvinyl chloride sheet having a thickness of 2 mm and a density of 1.8 g/cm$^3$ as a surface cover. Thereafter, sound pressure level in the automobile compartment is measured by running the automobile on a drum tester at a speed of 100 km/hr. Moreover, the sound pressure level is represented by A weighting and is a total energy over a frequency range of 125 Hz to 1.6 kHz.

The measured results are shown in Table 1.

Further, the transmission loss and absorption coefficient of the fiber gathered bodies themselves are shown in Table 2.

In this case, the transmission loss is measured according to a method of JIS A1416 in a reverberant room having a volume of 36 cm$^3$ using a sample obtained by sandwiching the fiber gathered body of 710×500×30 mm between a cold rolled steel sheet of 1 mm in thickness and a rubber sheet having a surface density of 4.5 kg/m$^2$, while the absorption coefficient is measured by means of a B & K 4002 model normal incidence absorption coefficient measuring device using the fiber gathered body of 99 mm in diameter without the surface cover and the back air layer.

TABLE 1

| | Apparent density (g/cm$^3$) | Outer peripheral length ratio (%) | Sound pressure level (dB) |
|---|---|---|---|
| Example 1 | 0.04 | 41 | 45 |
| Example 2 | 0.04 | 28 | 46 |
| Example 3 | 0.04 | 41 | 44 |
| Example 4 | 0.08 | 41 | 42 |
| Example 5 | 0.04 | 41 | 46 |
| Comparative Example 1 | 0.04 | 0 | 51 |
| Comparative Example 2 | 0.04 | 0 | 50 |

Note: The outer peripheral length ratio means a ratio of outer peripheral length of irregular section fiber to outer periphery of circle equivalent section.

TABLE 2

| | Transmission loss | | Normal incidence absorption coefficient | |
|---|---|---|---|---|
| | 500 Hz (dB) | 1 KHz (dB) | 500 Hz | 1 KHz |
| Example 1 | 38.5 | 52.5 | 0.32 | 0.68 |
| Example 2 | 38.5 | 52.0 | 0.30 | 0.68 |
| Example 3 | 39.0 | 53.1 | 0.36 | 0.75 |
| Example 4 | 39.5 | 54.0 | 0.48 | 0.88 |
| Example 5 | 37.9 | 52.1 | 0.30 | 0.65 |
| Comparative Example 1 | 35.1 | 49.0 | 0.18 | 0.47 |
| Comparative Example 2 | 35.5 | 49.5 | 0.20 | 0.55 |

As mentioned above, the sound absorbing material according to the invention is a fiber gathered body comprising at least 30% by weight of irregular section fibers, so that the sound absorbing and sound insulating performances are excellent as compared with the fiber gathered body comprised of circular section fibers at the same weight. This shows that the same performances can be maintained by using a material having a weight lighter than the weight of the conventional material or higher-performance sound absorbing or sound insulating materials can be provided under the condition that the weight is equal to that of the conventional material.

Furthermore, the heat fusible fiber or heat fusible composite short fiber is used as a binder, so that the whole shape of the fiber gathered body can sufficiently be maintained while restricting the number of bonding points to a minimum.

What is claimed is:

1. A sound absorbing material comprising a fiber gathered body shaped from at least 50% by weight of synthetic fiber staples having a yarn fineness of not more than 5 denier, and having a mean density of 0.02–0.2 g/cm$^3$, in which said fiber gathered body contains at least 30% by weight of irregular-shaped fibers having a sectional shape satisfying the following equation (I):

$$L = 1.2 \times (2\pi r) \quad \text{(I)}$$

when an outer peripheral length of the fiber is L, a sectional area of the fiber is S and a circle equivalent radius r is represented by the following equation:

$$r = \sqrt{(S/\pi)}\ .$$

2. A sound absorbing material according to claim 1, wherein said fiber gathered body is shaped by uniformly piling said fiber gathered bodies one upon the other and filling them in a mold, and then drying or heating with steam.

3. A sound absorbing material according to claim 1, wherein said synthetic fiber staple has a specific gravity of not more than 1.8.

* * * * *